US007612789B2

(12) United States Patent
Minami

(10) Patent No.: US 7,612,789 B2
(45) Date of Patent: Nov. 3, 2009

(54) IMAGE DISPLAY DEVICE AND TIMING CONTROLLER

(75) Inventor: Akihiro Minami, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 638 days.

(21) Appl. No.: 11/461,179

(22) Filed: Jul. 31, 2006

(65) Prior Publication Data

US 2007/0030232 A1 Feb. 8, 2007

(30) Foreign Application Priority Data

Aug. 3, 2005 (JP) ..... 2005-224951

(51) Int. Cl.
*G09G 5/02* (2006.01)

(52) U.S. Cl. ..... 345/699; 345/98; 345/204; 345/213; 345/698

(58) Field of Classification Search ..... 345/98, 345/204, 213, 698, 699
See application file for complete search history.

(56) References Cited

U.S. PATENT DOCUMENTS 4,716,406 A * 12/1987 Shionoya ..... 345/213
5,805,532 A * 9/1998 Murakami ..... 368/113
5,894,299 A * 4/1999 Tsuchiya et al. ..... 345/100
6,329,981 B1 * 12/2001 Lin et al. ..... 345/204
6,538,648 B1 * 3/2003 Koike et al. ..... 345/213
6,556,191 B1 * 4/2003 Ouchi ..... 345/204
6,636,205 B1 * 10/2003 Lasneski ..... 345/204
6,822,660 B2 * 11/2004 Kim ..... 345/699
7,173,670 B2 * 2/2007 Jang ..... 348/558
7,483,006 B2 * 1/2009 Wang et al. ..... 345/87

FOREIGN PATENT DOCUMENTS

JP 2004-45985 2/2004

OTHER PUBLICATIONS

U.S. Appl. No. 11/623,990, filed Jan. 17, 2007, Minami.

* cited by examiner

*Primary Examiner*—Richard Hjerpe
*Assistant Examiner*—Gregory J Tryder
(74) *Attorney, Agent, or Firm*—Oblon, Spivak, McClelland, Maier & Neustadt, L.L.P.

(57) ABSTRACT

It is an object to provide a timing controller and an image display device which are capable of recognizing the resolution of a display panel with a simple structure. Image signal line driving devices include integrated plural driving circuits which are connected to one another in a cascade manner. Further, the image signal line driving devices are also connected to one another in a cascade manner. A timing controller transmits a horizontal start pulse to the image signal line driving device, then receives the returned horizontal start pulse returned thereto after being circulated through the driving circuits included in the image signal line driving devices and determines the resolution (the number of pixels) in the horizontal direction of the liquid crystal display panel based on the interval between the transmission and the reception of the start pulse.

11 Claims, 13 Drawing Sheets

IMAGE DISPLAY DEVICE AND TIMING CONTROLLER

BACKGROUND OF THE INVENTION

1. Field of the Invention

The present invention relates to timing controllers mounted in image display devices such as liquid crystal display devices and, more particularly, to a technique for recognizing the resolution of a display panel.

2. Description of the Background Art

To a liquid crystal display device, for example, signals which are references for controlling the driving circuits in the liquid crystal display panel (hereinafter, referred to as "control reference signals"), clock signals which are references for the timings of operations and the like are input from the outside of the device, along with image data. The aforementioned control reference signals include a horizontal synchronization signal for synchronization in the horizontal direction of the liquid crystal display panel, a vertical synchronization signal for synchronization in the vertical direction of the liquid crystal display panel, a data enable signal indicative of the time period during which image data is effective, and the like. The image data and these control reference signals are input to a control circuit called a timing controller which is mounted in the liquid crystal display device.

The timing controller creates control signals for controlling the display panel driving circuits, based on the control reference signals, and transmits the control signals to the driving circuits, along with the image data. The driving circuits drive the liquid crystal display panel according to the control signals and the image data to cause it to display images (refer to Japanese Patent Application Laid-Open No. 2004-45985, for example).

The timing controller is required to correctly recognize the resolution of the liquid crystal display panel, in order to create proper control signals. In conventional liquid crystal display devices, information about the resolution to be recognized by the timing controller has been held as an invariable in advance in the timing controller or stored in a memory in the timing controller. However, in this case, the addressable resolutions are restricted by the respective timing controller.

Further, the timing controller may determine, by itself, the resolution of the liquid crystal display panel based on the length and the number of the data enable signals included in the control reference signals and may recognize it. However, various types of control reference signals are input to the timing controller, depending on the specification (design policy) of the scaler or the like for creating the control reference signals and, accordingly, control reference signals can not be adapted to all timing controllers. In the event that control reference signals which do not match (mismatch) with the specification of the timing controller are input to the timing controller, the timing controller can not be expected to create proper control signals. Accordingly, there may be cases where the liquid crystal display device incorporating the timing controller can not be combined with the device incorporating the scaler, depending on the correspondence between the timing controller and the scaler.

Also, if the timing controller is designed in consideration of mismatch with control reference signals, this will complicate the circuit structure of the timing controller, thereby inducing problems such as an increase of the fabrication cost.

SUMMARY OF THE INVENTION

It is an object of the present invention to provide a timing controller and an image display device which are capable of recognizing the resolution of the display panel with a simple structure.

An image display device according to a first aspect of the invention includes a display panel including plural image signal lines and plural scanning lines, plural driving circuits for driving the plural image signal lines, and a timing controller which transmits image signals to the plural driving circuits and also transmits a start pulse for defining the timings when the respective driving circuits take in the image signals. The plural driving circuits are connected to one another in a cascade manner in order to enable circulating the start pulse through the plural driving circuits. The timing controller receives the start pulse circulated through the plural driving circuits and determines the resolution of the display panel in the direction in which the image signal lines are arranged, based on the interval between the transmission and the reception of the start pulse.

An image display device according to a second aspect of the present invention includes a display panel including plural image signal lines and plural scanning lines, plural driving circuits for driving the plural scanning lines, and a timing controller which transmits a start pulse for defining the timings when the respective driving circuits drive the scanning lines. The plural driving circuits are connected to one another in a cascade manner in order to enable circulating the start pulse through the plural driving circuits. The timing controller receives the start pulse circulated through the plural driving circuits and determines the resolution of the display panel in the direction in which the scanning lines are arranged, based on the interval between the transmission and the reception of the start pulse.

A timing controller according to a third aspect of the present invention includes an output terminal for outputting a start pulse for defining the timings of operations of driving circuits for driving image signal lines or scanning lines in an image display device, and an input terminal for inputting a predetermined signal to the timing controller. The timing controller also includes a counter for measuring the interval between the outputting of the start pulse from the output terminal and the inputting of the predetermined signal to the input terminal, and a holding circuit for holding the measurement value of the counter.

According to the present invention, the timing controller can determine the resolution of the display panel by itself, even when it has not stored, in advance, information about it as an invariable. Accordingly, the timing controller can be applied to display devices having any resolutions, without restricting the resolution addressed thereby.

Further, the determination of the resolution is not performed based on control reference signals input from the outside of the timing controller. Accordingly, for example, even if the control reference signals do not match with the timing controller, the resolution can be determined. Accordingly, even if the control reference signals do not match, the timing controller can generate normal control signals. This eliminates the necessity of designing the timing controller in consideration of mismatch with control reference signals, which can prevent the circuit structure of the timing controller from being complicated, thereby contributing to the reduction of the fabrication cost. Further, this enables provision of a timing controller and a liquid crystal display device with excellent versatility, since the compatibility with control reference signals does not matter.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
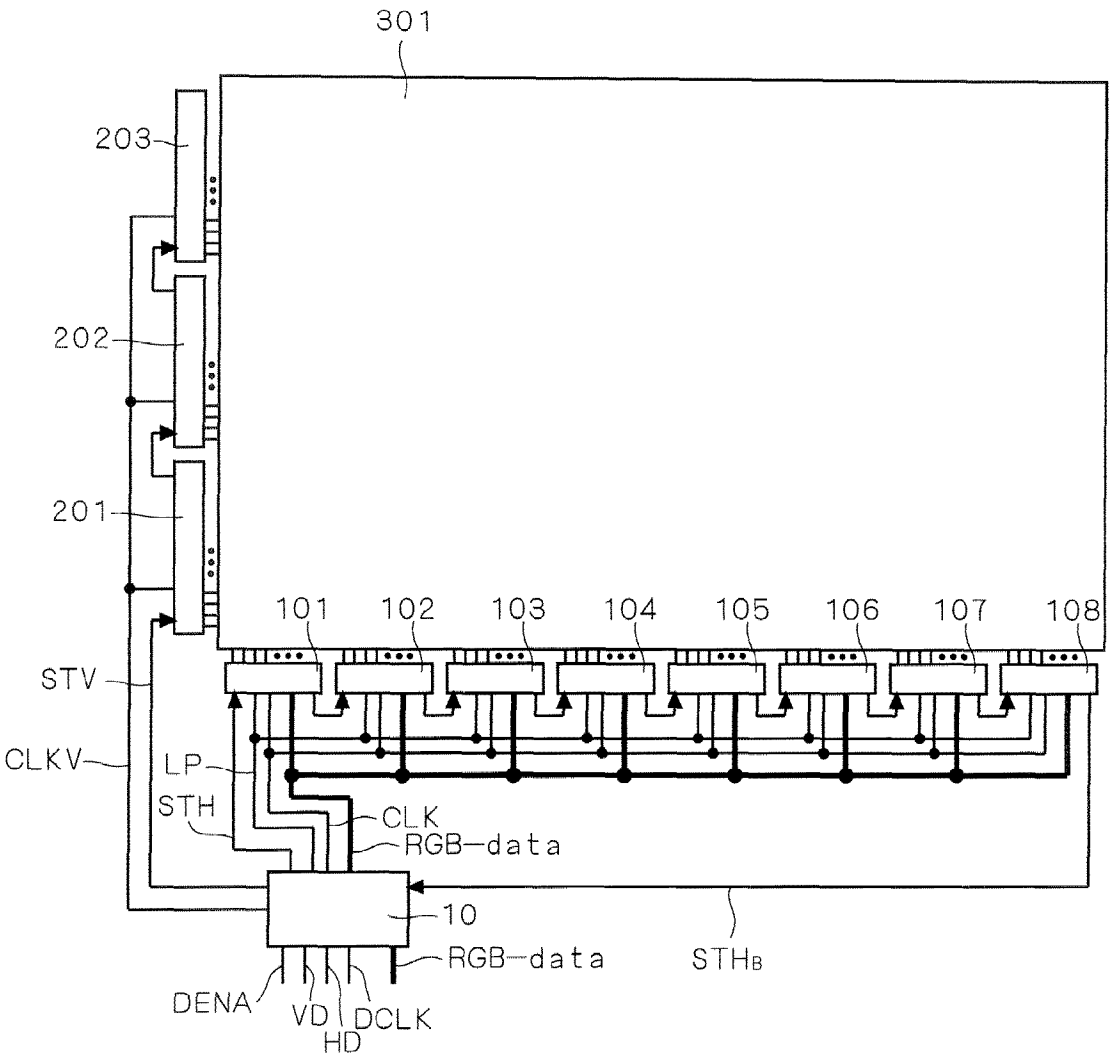
FIG. 1 is a block diagram illustrating main portions of a liquid crystal display device according to a first embodiment.

FIG. 1 is a block diagram illustrating main portions of a liquid crystal display device according to a first embodiment of the present invention. In this block diagram, for ease of description, there are illustrated only the flows of main signals and, for example, clock signals for synchronization among respective circuits are not illustrated (this also applies to the following respective figures).

As illustrated in FIG. 1, the liquid crystal display device includes a timing controller 10, image signal line driving devices 101 to 108, scanning line driving devices 201 to 203 and a liquid crystal display panel 301. In the present embodiment, the liquid crystal display panel 301 is a color liquid crystal display panel. In the liquid crystal display panel 301, there are provided plural image signal lines and plural scanning lines such that they are intersected with each other, and there are formed dots constituting pixels, at the respective intersections thereof arranged in a matrix shape.

In the present specification, the "dots" in the color liquid crystal display panel are defined as minimum display units for red (R), blue (B) or green (G) which are controlled in terms of light transmittance by a single TFT (Thin Film Transistor) on the liquid crystal display panel 301. Further, the "pixels" are constituted by combined three dots for R, G and B and are defined as minimum display units capable of displaying color spaces by being subjected to controlling of the individual respective dots. Namely, each of the pixels in the liquid crystal display panel 301 is constituted by three dots and, accordingly, the number of the image signal lines included in the liquid crystal display panel 301 is three times the number of the pixels in the horizontal direction (resolution).

Further, in the case of a monochrome liquid crystal display panel, each pixel is constituted by a single dot and, accordingly, the number of image signal lines included in the liquid crystal display panel is the same as the resolution in the horizontal direction. Further, regardless of whether the liquid crystal display panel is of a color type or a monochrome type, the resolution of the liquid crystal display panel in the vertical direction is the same as the number of scanning lines.

The image signal line driving devices 101 to 108 are integrated circuits for driving the image signal lines. More specifically, the respective image signal line driving devices 101 to 108 include integrated plural driving circuits for driving the individual image signal lines, wherein these plural driving circuits are connected to one another in a cascade manner within the respective image signal line driving devices 101 to 108. Further, as illustrated in FIG. 1, the image signal line driving devices 101 to 108 are also connected to one another in a cascade manner. Namely, all of the driving circuits integrated in the image signal line driving devices 101 to 108 are connected to one another in a cascade manner.

Further, the scanning line driving devices 201 to 203 are integrated circuits for driving the scanning lines. The respective scanning line driving devices 201 to 203 include integrated plural driving circuits for driving the respective scanning lines, wherein these plural driving circuits are connected to one another in a cascade manner within the respective scanning line driving devices 201 to 203. Further, as illustrated in FIG. 1, the scanning line driving devices 201 to 203 are also connected to one another in a cascade manner. Accordingly, all the driving circuits integrated in the scanning line driving devices 201 to 203 are connected to one another in a cascade manner.

Hereinafter, for ease of description, the plural driving circuits integrated in the image signal line driving devices 101 to 108 are collectively and simply referred to as "image signal line driving devices 101 to 108" and, similarly, the plural driving circuits integrated in the scanning line driving devices 201 to 203 are simply and collectively referred to as "scanning line driving devices 201 to 203".

A data enable signal DENA, a horizontal synchronization signal HD, a vertical synchronization signal VD and a clock DCLK are input to the timing controller 10, as signals which are references for controlling of the image signal line driving devices 101 to 108 and the scanning line driving devices 201 to 203 (control reference signals), along with RGB data (RGB-data) including red, green and blue image data. The data enable signal DENA is a signal indicative of the time interval during which RGB data is effective. The horizontal synchronization signal HD is a signal for synchronization in the horizontal direction of the liquid crystal display panel 301 and the vertical synchronization signal VD is a signal for synchronization in the vertical direction. The clock DCLK is a reference clock which defines the operation timing of the timing controller 10.

The timing controller 10 creates control signals for driving the image signal line driving devices 101 to 108 and the scanning line driving devices 201 to 203, based on the aforementioned control reference signals.

The control signals for the image signal line driving devices 101 to 108 include a clock CLK (hereinafter, referred to as "a horizontal clock CLK", a start pulse STH (hereinafter, referred to as "a horizontal start pulse STH"), a latch pulse LP and the like. The clock CLK is a reference clock for the operations of the image signal line driving devices 101 to 108.

The horizontal start pulse STH is a pulse signal indicating the head of RGB data in the horizontal direction and defines the timings when the RGB data is taken in by the respective driving circuits integrated in the image signal line driving devices 101 to 108. Namely, the horizontal start pulse STH is successively transferred to the image signal line driving devices 101, 102, . . . , 108 in this order, and the respective driving circuits in the image signal line driving devices 101 to 108 take in the RGB data in synchronization with the horizontal start pulse STH transferred from the previous stage in the cascade connection and then transfer the horizontal start pulse STH to the subsequent stage. This enables the individual driving circuits in the image signal line driving devices 101 to 108 to take in the RGB data which is transferred in serial, at respective predetermined timings.

Further, the latch pulse LP is a signal for defining the timing when the RGB data which has been taken in and held by the image signal line driving devices 101 to 108 is output to the image signal lines of the liquid crystal display panel 301. In addition, the control signals output from the timing controller 10 include a polarity reversing signal for reversing the polarity of driving of the liquid crystal. The timing controller 10 transmits these control signals, along with the RGB data, to the image signal line driving devices 101 to 108.

On the other hand, the control signals for the scanning line driving devices 201 to 203 include a clock CLKV (hereinafter, referred to as "a vertical clock CLKV") which is a reference clock for the operations of the scanning line driving devices 201 to 203, a start pulse STV (hereinafter, referred to as "a vertical start pulse STV") which defines the timing of starting vertical scanning, and the like.

The vertical start pulse STV is transferred to the scanning line driving devices 201, 202 and 203, in the mentioned order. The respective driving circuits integrated in the scanning line driving devices 201 to 203 drive the scanning lines of the liquid crystal display panel 301 in synchronization with the vertical start pulse STV transferred from the previous stage in the cascade connection and transfer the vertical start pulse STV to the subsequent stage. Consequently, the driving circuits in the scanning line driving devices 201 to 203 successively bring the scanning lines of the liquid crystal display panel 301 into an active state (namely, they scans the liquid crystal display panel 301).

As described above, in the liquid crystal display device, the scanning line driving devices 201 to 203 scan the liquid crystal display panel 301 based on the vertical start pulse STV, while the image signal line driving devices 101 to 108 take in the RGB data based on the horizontal start pulse STH and write it into the respective pixels. The operation is repeated to display an image over the entire liquid crystal display panel 301.

In this case, each of the image signal line driving devices 101 to 108 includes an input terminal and an output terminal for the horizontal start pulse STH, in order to enable connecting them in a cascade manner. Similarly, each of the scanning line driving devices 201 to 203 includes an input terminal and an output terminal for the vertical start pulse STV, in order to enable connecting them in a cascade manner. In conventional liquid crystal display devices, generally, nothing is connected to the image signal line driving device in the last stage (namely, the image signal line driving device 108) at its output terminal for the horizontal start pulse STH, and also nothing is connected to the scanning line driving device in the last stage (namely, the scanning line driving device 203) at its output terminal for the vertical start pulse STV.

On the contrary, in the present embodiment, the timing controller 10 is connected to the image signal line driving device 108 at its output terminal for the horizontal start pulse STH, as illustrated in FIG. 1. Accordingly, the timing controller 10 includes an input terminal for the horizontal start pulse STH from the image signal line driving device 108, in addition to an output terminal for the horizontal start pulse STH. Namely, in the present embodiment, the horizontal start pulse STH output from the timing controller 10 is circulated through the image signal line driving devices 101 to 108 and is returned to the timing controller 10. Hereinafter, for ease of description, the horizontal start pulse STH returned after being circulated through the image signal line driving devices 101 to 108 is referred to as a "returned horizontal start pulse $STH_B$".

Further, the timing controller 10 according to the present embodiment includes a horizontal resolution determination portion for determining the resolution of the liquid crystal display panel 301 in the horizontal direction (namely, the direction in which the image signal lines are arranged), based on the interval between the transmission of the horizontal start pulse STH and the reception of the returned horizontal start pulse $STH_B$.

Figure 2:
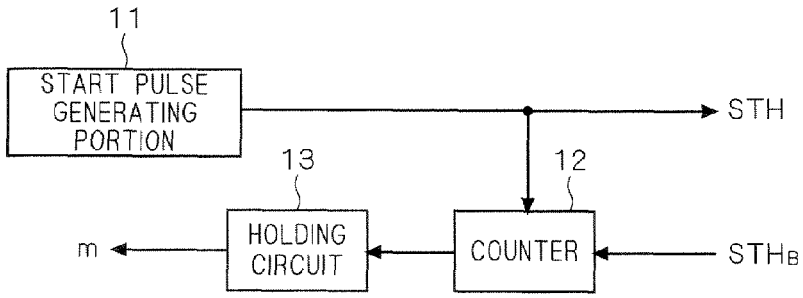
FIG. 2 is a block diagram illustrating a horizontal start pulse generating portion and a horizontal resolution determination portion included in a timing controller according to the first embodiment.

FIG. 2 is a block diagram illustrating a horizontal start pulse generating portion and the horizontal resolution determination portion included in the timing controller 10. The start pulse generating portion 11 in the same figure is a circuit for generating horizontal start pulses STHs. The horizontal resolution determination portion is constituted by a counter 12 to which the horizontal start pulse STH from the start pulse generating portion 11 and the returned horizontal start pulse $STH_B$ from the image signal line driving device 108 are input and a holding circuit 13 for holding the count value (measured value) of the counter 12.

Figure 3:
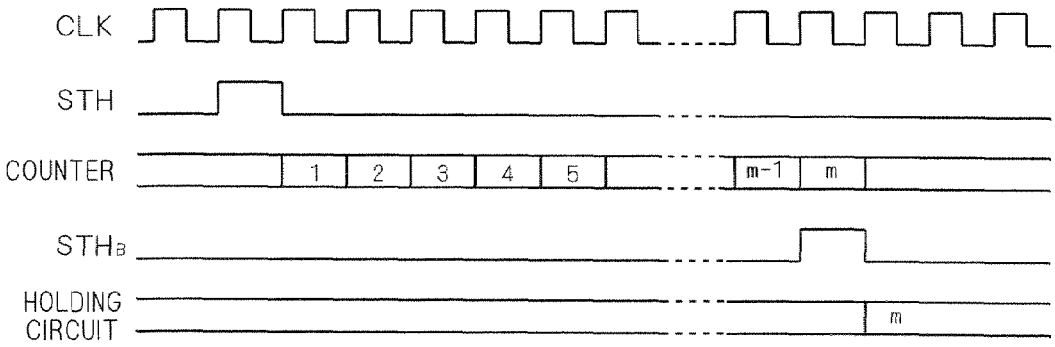
FIG. 3 is a timing chart illustrating the operation of the horizontal resolution determination portion according to the first embodiment.

FIG. 3 is a timing chart illustrating the operation of the aforementioned horizontal resolution determination portion. The counter 12 starts counting at the timing when the start pulse generating portion 11 outputs a horizontal start pulse STH, then increases the count value in synchronization with the horizontal clock CLK and stops the counting at the timing when the returned horizontal start pulse $STH_B$ is returned thereto. Namely, the counter 12 measures the interval between the transmission of a start pulse STH from the timing controller 10 and the reception of the retuned horizontal start pulse $STH_B$. On receiving the returned horizontal start pulse $STH_B$, the counter 12 transmits the count value m at the time to the holding circuit 13 and the holding circuit 13 holds it.

The horizontal start pulse STH is circulated through the driving circuits integrated in the image signal line driving devices 101 to 108 to command them to take in image signals and then is returned as a returned horizontal start pulse $STH_B$ to the timing controller 10. During this, the timing controller 10 transmits RGB data for a single pixel to the image signal line driving devices 101 to 108, for every single tick of the horizontal clock CLK. Accordingly, the count value m of when the timing controller 10 receives the returned horizontal start pulse $STH_B$ corresponds to the number of the horizontal pixels (the horizontal resolution) of the liquid crystal display panel 301. This enables the timing controller 10 to determine the horizontal resolution of the liquid crystal display panel 301 by itself and recognize it, by referring to the count value m held by the holding circuit 13.

Also, the timing controller 10 may transmit RGB data for plural pixels, to the image signal line driving devices 101 to 108, for every single tick of the horizontal clock CLK, depending on the specification of the timing controller 10. In the present embodiment, if it is assumed that RGB data for k pixels is transmitted for every single tick of the clock, the holding circuit 13 in the horizontal resolution determination portion holds a count value m which is 1/k of the actual number of horizontal pixels. Accordingly, in this case, the holding circuit 13 may perform processing for multiplying the count value m by k and holding the multiplied count value or the timing controller 10 may perform processing for referring to the count value m, multiplying it by k and recognizing the multiplied count value.

The timing controller 10 according to the present embodiment can determine the resolution of the liquid crystal display panel 301 by itself, even when it has not stored information about it as an invariable in advance. Accordingly, the timing controller 10 can be applied to display devices having any resolutions, without restricting the resolution addressed thereby.

Further, the determination of the resolution is not performed based on control reference signals input from the outside of the timing controller 10, such as data enable signals. Accordingly, for example, even if the control reference signals do not match with the timing controller, the resolution can be determined. Accordingly, even if the control reference signals do not match, the timing controller 10 can generate normal control signals. This eliminates the necessity of designing the timing controller 10 in consideration of mismatch with control reference signals, which can prevent the circuit structure of the timing controller 10 from being complicated, thereby contributing to the reduction of the fabrication cost. Further, this enables provision of a liquid crystal display device with excellent versatility, since the compatibility with control reference signals does not matter.

Second Embodiment

Figure 4:
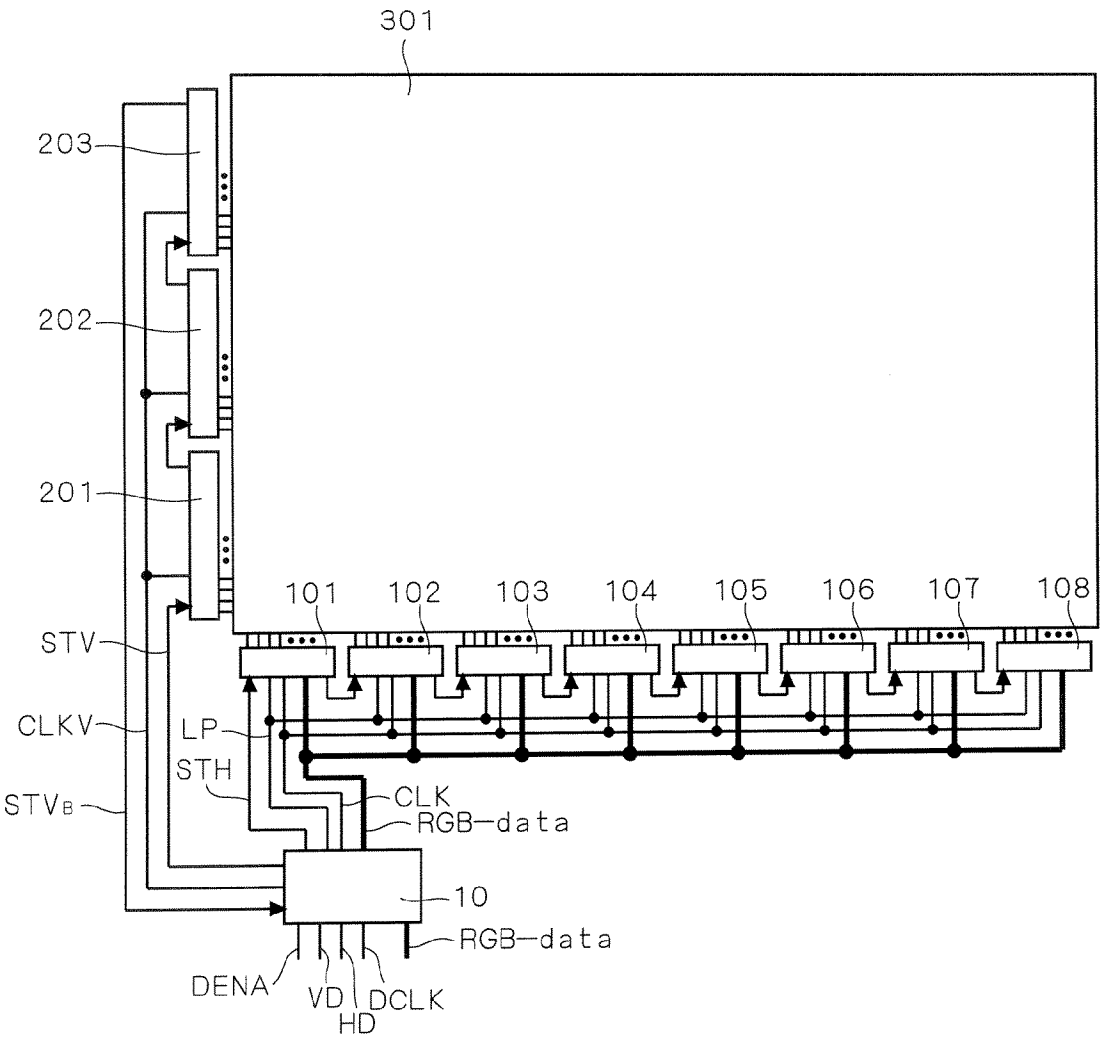
FIG. 4 is a block diagram illustrating main portions of a liquid crystal display device according to a second embodiment.

FIG. 4 is a block diagram illustrating main portions of a liquid crystal display device according to a second embodiment of the present invention. In the figure, components having the same functions as those in FIG. 1 are designated by the same reference characters, and detailed description thereof will be omitted.

As previously described, the scanning line driving devices 201 to 203 are connected to one another in a cascade manner, and a vertical start pulse STV is transferred to the scanning line driving devices 201, 202 and 203 in the mentioned order. Further, each of the scanning line driving devices 201 to 203 includes an input terminal and an output terminal for the vertical start pulse STV, in order to enable connecting them in a cascade manner. In conventional liquid crystal display devices, generally, nothing is connected to the scanning line driving device in the last stage (namely, the scanning line driving device 203) at its output terminal for the vertical start pulse STV.

On the contrary, in the present embodiment, the timing controller 10 is connected to the scanning line driving device 203 at its output terminal for the vertical start pulse STV, as illustrated in FIG. 4. Namely, the timing controller 10 includes an input terminal for the vertical start pulse STV from the scanning line driving device 203, in addition to an output terminal for the vertical start pulse STV. Namely, in the present embodiment, the vertical start pulse STV output from the timing controller 10 is circulated through the scanning line driving devices 201 to 203 and is returned to the timing controller 10. Hereinafter, for ease of description, the vertical start pulse STV returned after being circulated through the image signal line driving devices 101 to 108 will be referred to as a "returned vertical start pulse $STV_B$".

Further, the timing controller 10 according to the present embodiment includes a vertical resolution determination portion for determining the resolution of the liquid crystal display panel 301 in the vertical direction (namely, the direction in which the scanning lines are arranged), based on the interval between the transmission of the vertical start pulse STV and the reception of the returned vertical start pulse $STV_B$.

Figure 5:
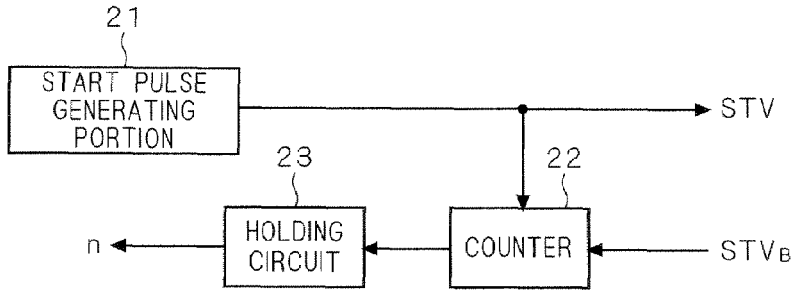
FIG. 5 is a block diagram illustrating a vertical start pulse generating portion and a vertical resolution determination portion included in the timing controller according to the second embodiment.

FIG. 5 is a block diagram illustrating a vertical start pulse generating portion and a vertical resolution determination portion included in the timing controller 10. The start pulse generating portion 21 in the same figure is a circuit for generating vertical start pulses STVs. The vertical resolution determination portion is constituted by a counter 22 to which the vertical start pulse STV from the start pulse generating portion 21 and the returned vertical start pulse $STV_B$ from the scanning line driving device 203 are input, and a holding circuit 23 for holding the count value (measurement value) of the counter 22.

Figure 6:
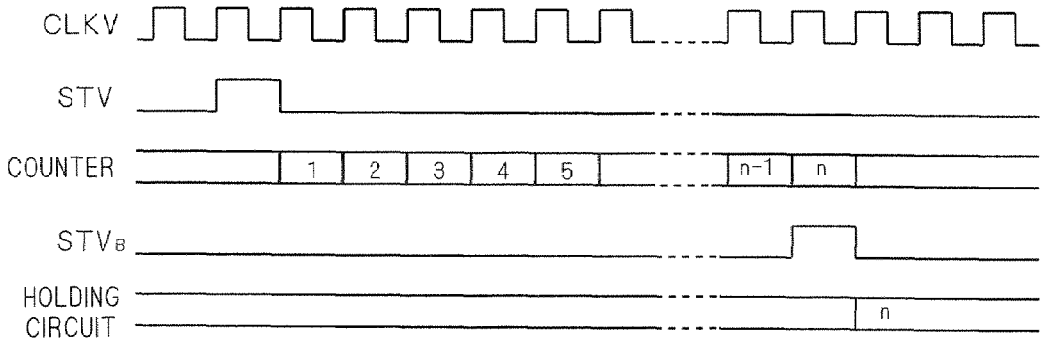
FIG. 6 is a timing chart illustrating the operation of the vertical resolution determination portion according to the second embodiment.

FIG. 6 is a timing chart illustrating the operation of the vertical resolution determination portion according to the present embodiment. As illustrated in the same figure, the counter 22 starts counting at the timing when the start pulse generating portion 21 outputs a vertical start pulse STV, then increases the count value in synchronization with the vertical clock CLKV and stops the counting at the timing when the returned vertical start pulse $STV_B$ is returned thereto. Namely, the counter 22 measures the interval between the transmission of the vertical start pulse STV from the timing controller 10 and the reception of the retuned vertical start pulse $STV_B$. On receiving the returned vertical start pulse $STV_B$, the counter 22 transmits the count value n at the time to the holding circuit 23 and the holding circuit 23 holds it.

The vertical start pulse STV is circulated through the driving circuits in the scanning line driving devices 201 to 203 to command them to drive the respective scanning lines and then is returned as a returned vertical start pulse $STV_B$ to the timing controller 10. Accordingly, the aforementioned count value n corresponds to the number of the scanning lines in the liquid crystal display panel 301, namely the vertical resolution (the number of vertical pixels) thereof. This enables the timing controller 10 to determine, by itself, the vertical resolution of the liquid crystal display panel 301 and recognize it, by referring to the count value n held by the holding circuit 23.

The timing controller 10 according to the present embodiment can determine the resolution of the liquid crystal display panel 301 by itself, even when it has not stored, in advance, information about it as an invariable. Accordingly, the timing controller 10 can be applied to display devices having any resolutions, without restricting the resolution addressed thereby.

Further, the determination of the resolution is not performed based on control reference signals input from the outside of the timing controller 10, such as data enable signals. Accordingly, for example, even if the control reference signals do not match with the timing controller, the resolution can be determined. Accordingly, even if the control reference signals do not match, the timing controller 10 can generate normal control signals. This eliminates the necessity of designing the timing controller 10 in consideration of mismatch with control reference signals, which can prevent the circuit structure of the timing controller 10 from being complicated, thereby contributing to the reduction of the fabrication cost. Further, this enables provision of a liquid crystal display device with excellent versatility, since the compatibility with control reference signals does not matter.

While, in the present embodiment, the timing controller 10 is configured to include only the vertical resolution determination portion for determining the vertical resolution of the liquid crystal display panel 301, it may be combined with the horizontal resolution determination portion according to the first embodiment. In this case, the timing controller 10 is enabled to determine both the vertical resolution and the horizontal resolution of the liquid crystal display panel 301, thereby offering the effects of both the first embodiment and the second embodiment.

Third Embodiment

In the third embodiment, a modified example of the aforementioned second embodiment will be described. In the present embodiment, the liquid crystal display has the same structure as that in FIG. 4, and the timing controller 10 includes a vertical resolution determination portion having the same structure as that of FIG. 5.

In the present embodiment, similarly to in the second embodiment, the timing controller 10 determines the vertical resolution of the liquid crystal display panel 301, based on the interval between the transmission of a vertical start pulse STV and the reception of the returned vertical start pulse $STV_B$.

Figure 7:
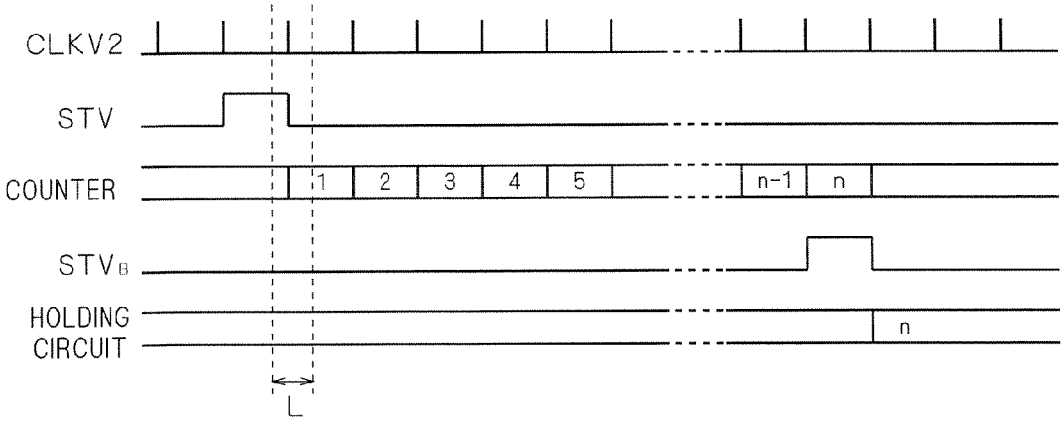
FIG. 7 is a timing chart illustrating the operation of a vertical resolution determination portion according to a third embodiment.

FIG. 7 is a timing chart illustrating the operation of a vertical resolution determination portion according to the third embodiment. The counter 22 starts counting at the timing when the start pulse generating portion 21 outputs a vertical start pulse STV, then increases the count value in synchronization with predetermined clock pulses CLKV2 and stops the counting at the timing when the returned vertical start pulse $STV_B$ is returned thereto. On receiving the returned vertical start pulse $STV_B$, the counter 22 transmits the count value n at the time to the holding circuit 23 and the holding circuit 23 holds it. As can be seen from the comparison with FIG. 6, the operation of the vertical resolution determination portion according to the present embodiment is the same as that in the second embodiment, except that the timings of operations are defined by the clock pulses CLKV2.

Figure 8:
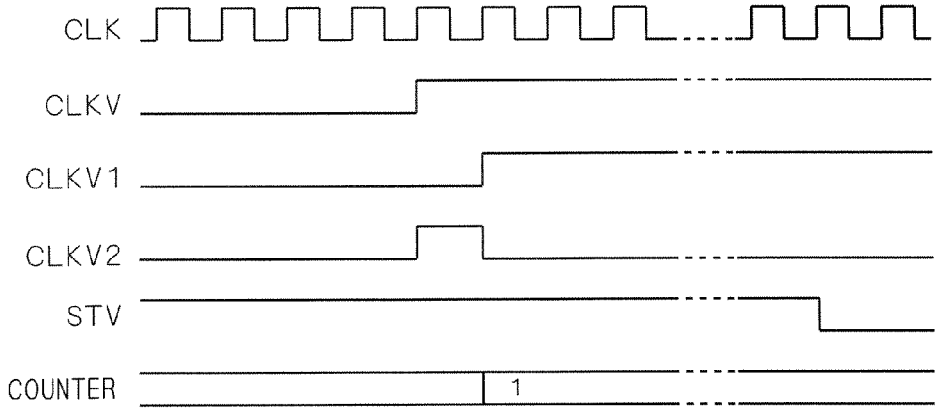
FIG. 8 is a timing chart illustrating the operation of the vertical resolution determination portion according to the third embodiment.

The aforementioned clock pulses CLKV2 will be described. FIG. 8 is a timing chart illustrating the operation of the vertical resolution determination portion during the time interval L illustrated in FIG. 7. As illustrated in FIG. 8, the clock pulses CLKV2 are signals created from a vertical clock CLKV and a delayed clock CLKV1 created by delaying the vertical clock CLKV by a single period of a horizontal clock CLK. Consequently, the timings of the operations of the vertical resolution determination portion according to the present embodiment are eventually synchronized with the horizontal clock CLK.

The present embodiment is effective, particularly when it is combined with the horizontal resolution determination portion according to the first embodiment. While the horizontal resolution determination portion according to the first embodiment operates based on the horizontal clock CLK, the vertical resolution determination portion according to the second embodiment operates based on the vertical clock CLKV and, accordingly, it is relatively difficult to combine these two embodiments due to the difference of the reference clocks. On the contrary, the vertical resolution determination portion according to the third embodiment operates based on the horizontal clock CLK similarly to in the first embodiment, thereby offering the advantage that it can be easily combined with the first embodiment.

Fourth Embodiment

There are some liquid crystal display devices including image signal line driving circuits and scanning line driving circuits which are divided into plural groups such that the respective groups are driven with different start pulses, in order to realize high resolutions.

Figure 9:
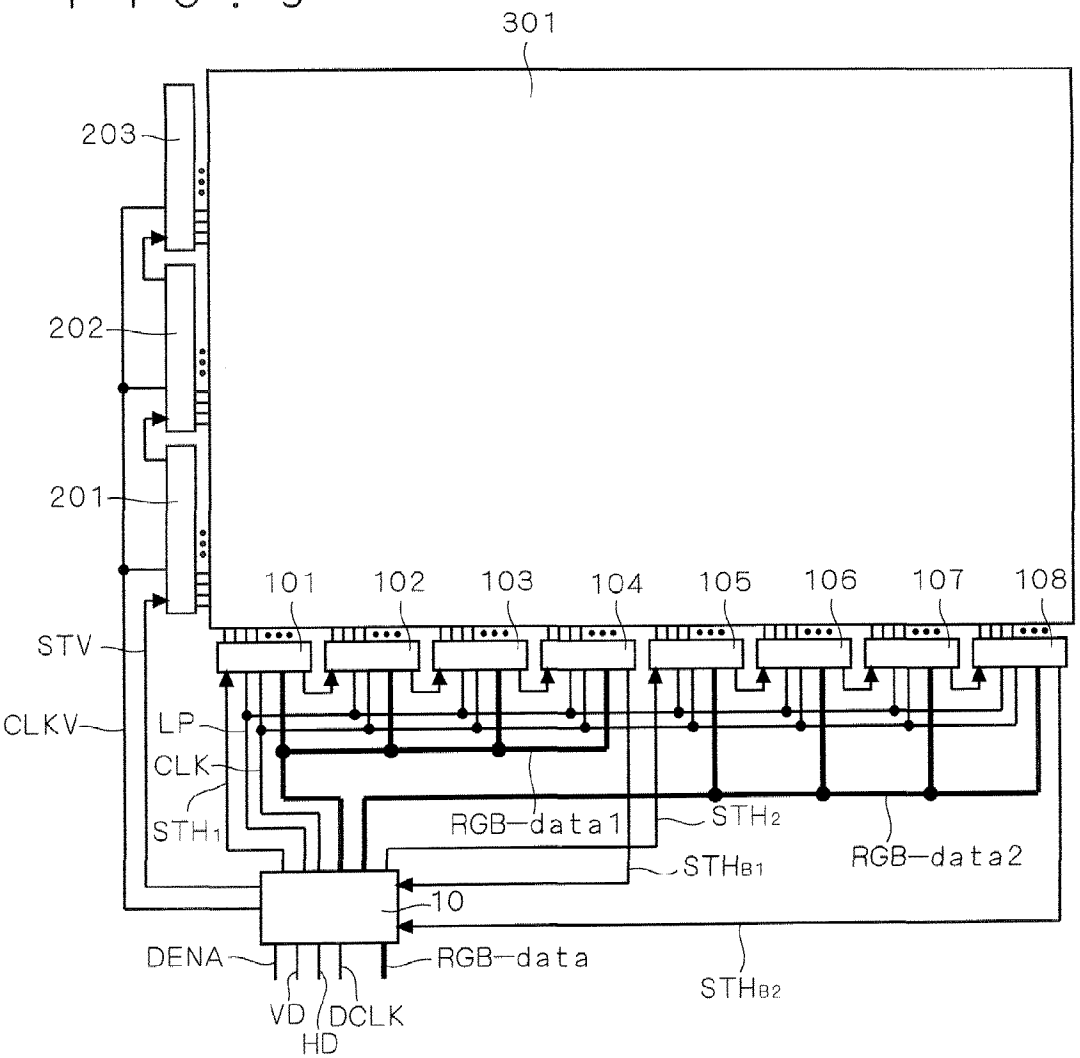
FIG. 9 is a block diagram illustrating main portions of a liquid crystal display device according to a fourth embodiment.

FIG. 9 is a block diagram illustrating main portions of a liquid crystal display device according to a fourth embodiment of the present invention. In the present embodiment, the driving circuits in the image signal line driving devices 101 to 108 are divided into a first group of the image signal line driving devices 101 to 104 and a second group of the image signal line driving devices 105 to 108, and the first and second groups are driven with a first horizontal start pulse $STH_1$ and a second horizontal start pulse $STH_2$, respectively. Further, RGB data is also divided into data for the first group (RGB-data1 (RGB data for the left half of the screen, in this example) and data for the second group (RGB-data2 (RGB data for the right half of the screen, in this example), and these divided RGB data are transmitted to the respective groups. This enables the image signal line driving devices 101 to 108 to take in a greater amount of RGB data, using a horizontal clock CLK having a frequency smaller than usual. Namely, this can increase the resolution while suppressing the increase of unnecessary radiation along with the increase of the frequency of the horizontal clock CLK.

In the first group, the image signal line driving devices 101 to 104 are connected to one another in a cascade manner, and a first horizontal pulse $STH_1$ is transferred to the image signal line driving devices 101, 102, 103 and 104 in this order. The first horizontal start pulse $STH_1$ is circulated through the respective driving circuits in the image signal line driving devices 101 to 104 and is input, as a first returned horizontal start pulse $STH_{B1}$, to the timing controller 10.

Further, in the second group, the image signal line driving devices 105 to 108 are connected to one another in a cascade manner, and a second horizontal pulse $STH_2$ is transferred to the image signal line driving devices 105, 106, 107 and 108 in this order. The second horizontal start pulse $STH_2$ is circulated through the respective driving circuits in the image signal line driving devices 105 to 108 and is input, as a second returned horizontal start pulse $STH_{B2}$, to the timing controller 10.

Namely, the timing controller 10 includes an input terminal for the first returned horizontal start pulse $STH_{B1}$ from the image signal line driving device 104 and an input terminal for the second returned horizontal start pulse $STH_{B2}$ from the image signal line driving device 108, in addition to an output terminal for outputting the first horizontal start pulse $STH_1$ and the second horizontal start pulse $STH_2$.

Figure 10:
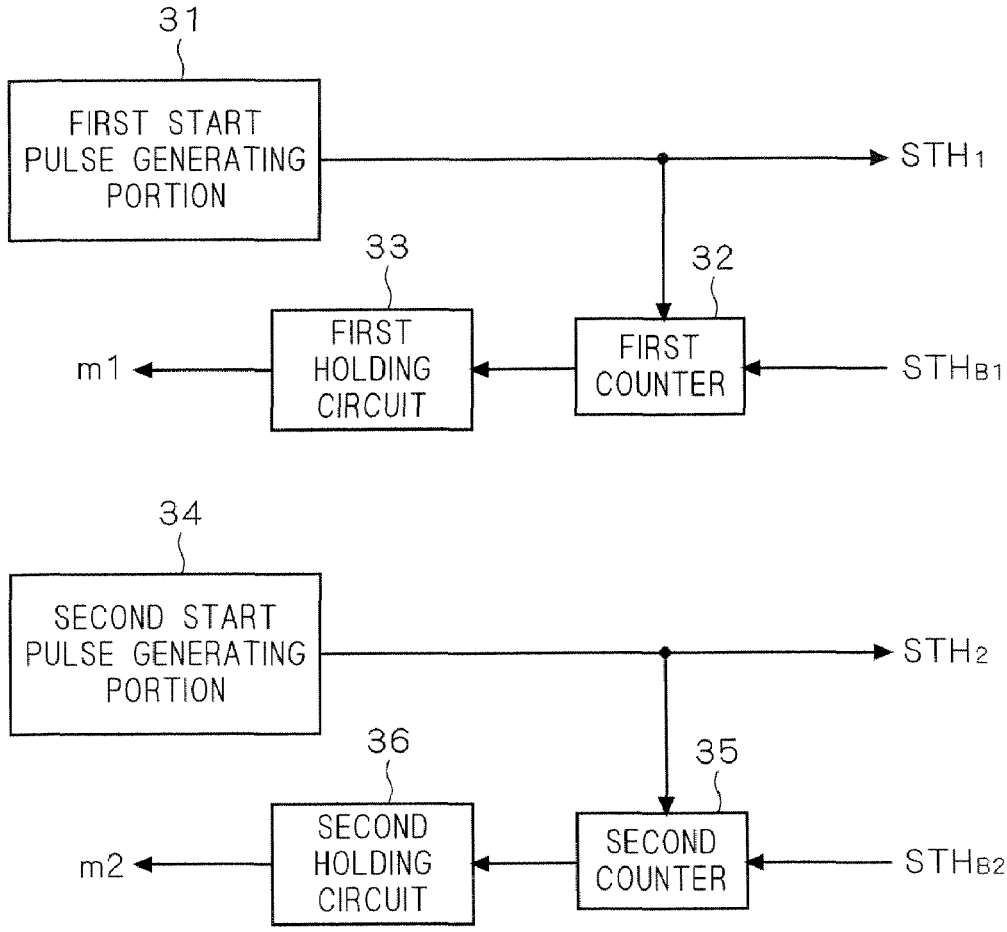
FIG. 10 is a block diagram illustrating a horizontal start pulse generating portion and a horizontal resolution determination portion included in a timing controller according to the fourth embodiment.

FIG. 10 is a block diagram illustrating a horizontal start pulse generating portion and a horizontal resolution determination portion included in the timing controller 10 according to the present embodiment. In the same figure, the first start pulse generating portion 31 is a circuit for generating first horizontal start pulses $STH_1$, and the second start pulse generating portion 34 is a circuit for generating second horizontal start pulses $STH_2$. The horizontal resolution determination portion includes a first determination portion constituted by a first counter 32 and a first holding circuit 33 and a second determination portion constituted by a second counter 35 and a second holding circuit 36.

Both the first and second determination portions operate similarly to the horizontal resolution determination portion according to the first embodiment. Namely, in the first determination portion, the first counter 32 measures the interval (a count value of m1) between the transmission of the first horizontal start pulse $STH_1$ from the timing controller 10 and the reception of the first returned horizontal start pulse $STH_{B1}$, and the first holding circuit 33 holds it. Similarly, in the second determination portion, the second counter 35 measures the interval (a count value of m2) between the transmission of the second horizontal start pulse $STH_2$ from the timing controller 10 and the reception of the second returned horizontal start pulse $STH_{B2}$, and the second holding circuit 36 holds it.

The count value m1 corresponds to the number of the horizontal pixels in the region of the liquid crystal display panel 301 which is driven by the image signal line driving devices 101 to 104 (the first group) and the count value m2 corresponds to the number of the horizontal pixels in the region thereof which is driven by the image signal line driving devices 105 to 108 (the second group), which enables the timing controller 10 to determine the respective numbers of the horizontal pixels in the regions which are driven by the first and second groups, by referring to the count values m1 and m2 held by the first holding circuit 33 and the second holding circuit 36, respectively. Further, the timing controller 10 is enabled to determine the horizontal resolution of the entire liquid crystal display panel 301 and recognize it, from the result of the aforementioned determination.

As described above, the timing controller according to the present embodiment includes an output terminal for the horizontal start pulse, an input terminal to which the returned horizontal start pulse is input, a counter for measuring the interval between the transmission of the horizontal start pulse and the reception of the returned horizontal start pulse and a holding circuit for holding the counter measurement value, for each group of image signal line driving circuits. Accordingly, the timing controller can be applied to a liquid crystal display device which employs a method of driving the image signal lines using plural start pulses. Namely, it is possible to offer the same effects as those of the first embodiment with such a liquid crystal display device.

Fifth Embodiment

Figure 11:
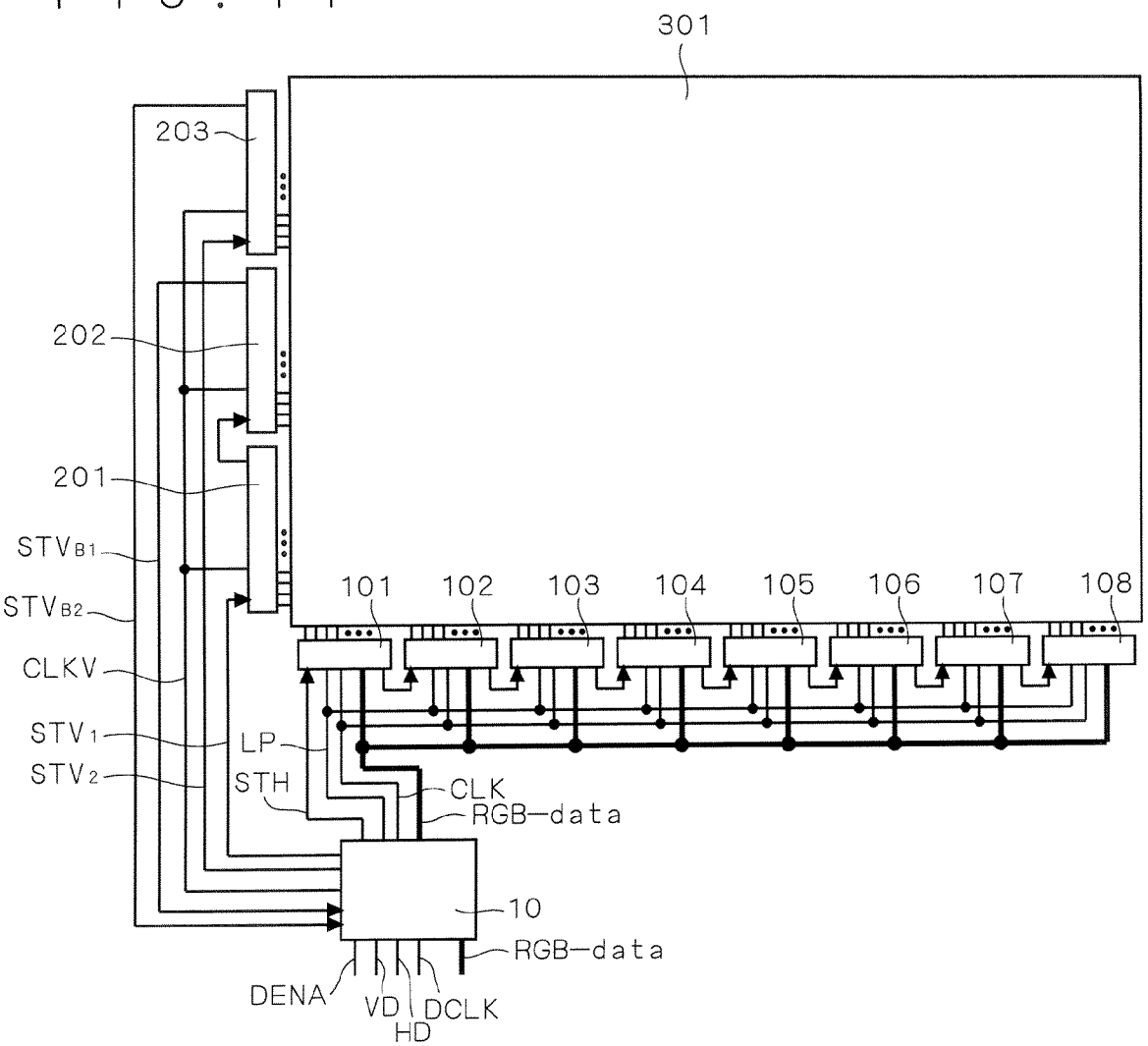
FIG. 11 is a block diagram illustrating main portions of a liquid crystal display device according to a fifth embodiment.

FIG. 11 is a block diagram illustrating main portions of a liquid crystal display device according to a fifth embodiment of the present invention. In the present embodiment, the driving circuits in the scanning line driving devices 201 to 203 are divided into a first group of the scanning line driving devices 201 and 202 and a second group of the scanning line driving device 203, and the first and second groups are driven with a first vertical start pulse $STV_1$ and a second vertical start pulse $STV_2$, respectively.

In the first group, the scanning line driving devices 201 and 202 are connected to one another in a cascade manner, and the first vertical start pulse STV, is transferred to the scanning line driving devices 201 and 202, in this order. The first vertical start pulse $STV_1$ is input as a first returned vertical start pulse $STV_{B1}$ to the timing controller 10, after passing through the scanning line driving devices 201 and 202.

Further, the scanning line driving device 203 belongs to the second group, and the second vertical start pulse $STV_2$ is input to the scanning line driving device 203 and then is input as a second retuned vertical start pulse $STV_{B2}$ to the timing controller 10 after passing through the scanning line driving device 203.

Namely, the timing controller 10 includes an input terminal for the first returned vertical start pulse $STV_{B1}$ from the scanning line driving device 202 and an input terminal for the second returned vertical start pulse $STV_{B2}$ from the scanning line driving device 203, in addition to an output terminal for the first vertical start pulse $STV_1$ and an output terminal for the second vertical start pulse $STV_2$.

Figure 12:
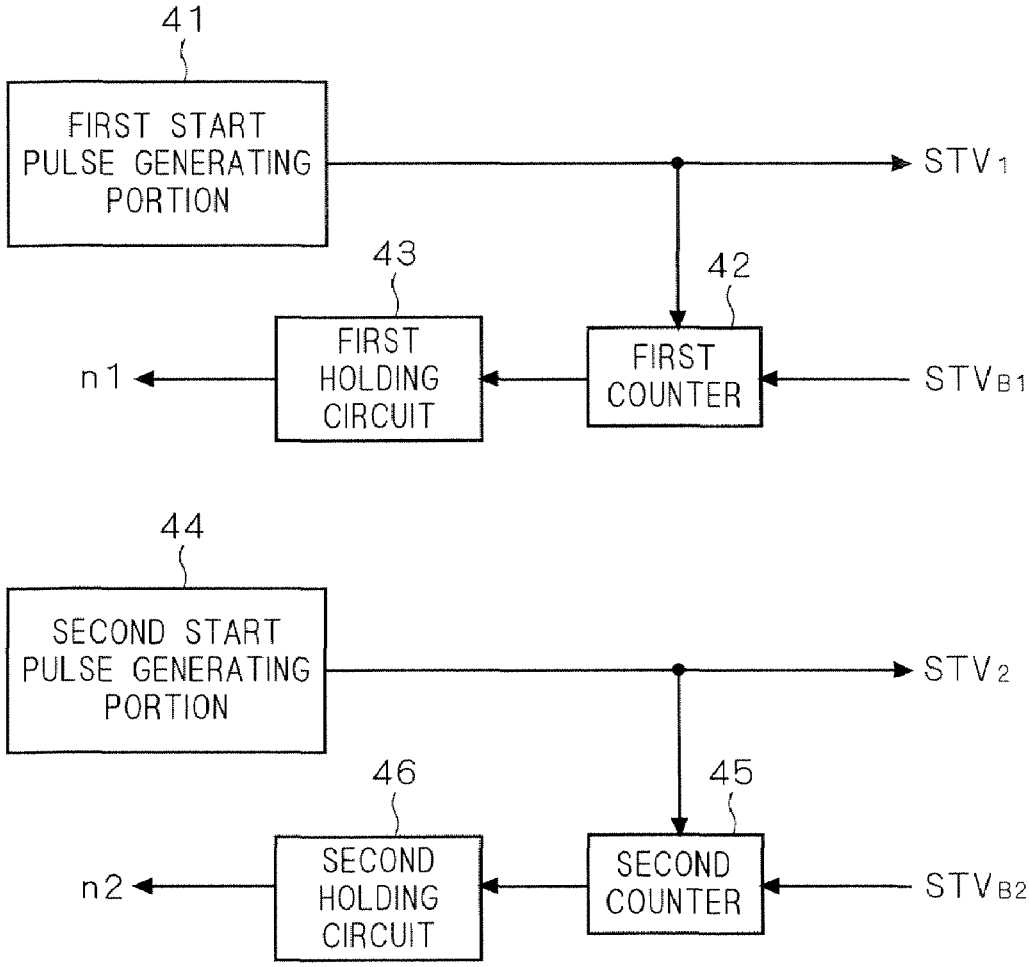
FIG. 12 is a block diagram illustrating a vertical start pulse generating portion and a vertical resolution determination portion included in the timing controller according to the fifth embodiment.

FIG. 12 is a block diagram illustrating a vertical start pulse generating portion and a vertical resolution determination portion included in the timing controller 10 according to the present embodiment. In the same figure, the first start pulse generating portion 41 is a circuit for generating first vertical start pulses $STV_1$, and the second start pulse generating portion 44 is a circuit for generating second vertical start pulses $STV_2$. The vertical resolution determination portion includes a first determination portion constituted by a first counter 42 and a first holding circuit 43 and a second determination portion constituted by a second counter 45 and a second holding circuit 46.

The first and second determination portions operate similarly to the vertical resolution determination portion according to the second embodiment or the third embodiment. Namely, in the first determination portion, the first counter 42 measures the interval (a count value n1) between the transmission of the first vertical start pulse $STV_1$ from the timing controller 10 and the reception of the first returned vertical start pulse $STV_{B1}$, and the first holding circuit 43 holds it. Similarly, in the second determination portion, the second counter 45 measures the interval (a count value of n2) between the transmission of the second vertical start pulse $STV_2$ from the timing controller 10 and the reception of the second returned vertical start pulse $STV_{B2}$, and the second holding circuit 46 holds it.

The count value n1 corresponds to the number of the vertical pixels in the region of the liquid crystal display panel 301 which is driven by the scanning line driving devices 201 and 202 (the first group) and the count value n2 corresponds to the number of the vertical pixels in the region thereof which is driven by the scanning line driving device 203 (the second group), which enables the timing controller 10 to determine the respective numbers of the vertical pixels in the regions which are driven by the first and second groups, by referring to the count values n1 and n2 held by the first holding circuit 43 and the second holding circuit 46, respectively. Further, the timing controller 10 is enabled to determine the vertical resolution of the entire liquid crystal display panel 301 and recognize it, from the result of the aforementioned determination.

As described above, the timing controller according to the present embodiment includes an output terminal for the vertical start pulse, an input terminal to which the returned vertical start pulse is input, a counter for measuring the interval between the transmission of the vertical start pulse and the reception of the returned vertical start pulse and a holding circuit for holding the counter measurement value, for each group of scanning line driving circuits. Accordingly, the timing controller can be applied to a liquid crystal display device which employs a method of driving the scanning lines using plural vertical start pulses. Namely, it is possible to offer the same effects as those of the second embodiment or the third embodiment with such a liquid crystal display device.

Sixth Embodiment

In the liquid crystal display devices described in the aforementioned embodiments, the direction of the order in which the image signal line driving devices take in RGB data (hereinafter, referred to as "the direction of intake"), namely the direction in which the horizontal start pulse is transferred to the image signal line driving devices, is fixed to a single direction. However, some liquid crystal displays are capable of switching the direction of intake, depending on the specification of RGB data.

Figure 13:
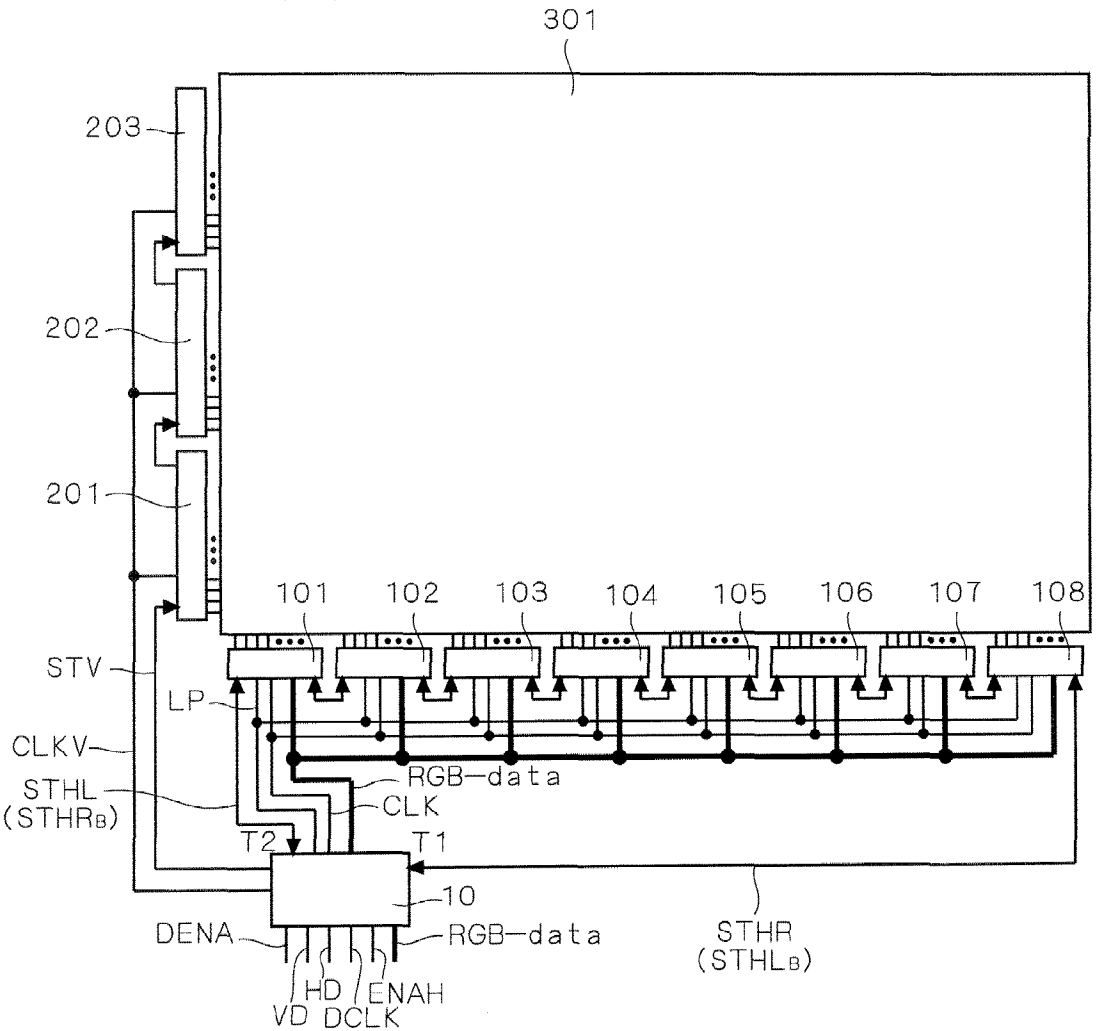
FIG. 13 is a block diagram illustrating main portions of a liquid crystal display device according to a sixth embodiment.

In the sixth embodiment, the present invention is applied to a liquid crystal display device capable of switching the direction of intake of RGB data, namely the direction in which the horizontal start pulse is transferred. FIG. 13 is a block diagram illustrating main portions of the liquid crystal display device according to the present embodiment. Along with RGB data, a designation signal ENAH which designates the direction of intake thereof is input to the timing controller 10. Namely, the timing controller 10 operates, based on the designation signal ENAH, to switch between outputting the horizontal start pulse STH to the image signal line driving device 101 and outputting it to the image signal line driving device 108.

Hereinafter, for ease of description, the horizontal start pulse STH output from the timing controller 10 to the image signal line driving device 101 will be referred to as a "horizontal start pulse STHL", and the horizontal start pulse STHL returned to the timing controller 10 after being circulated through the image signal line driving devices 101 to 108 will be referred to as a "returned horizontal pulse $STHL_B$". Further, the horizontal start pulse STH output from the timing controller 10 to the image signal line driving device 108 will be referred to as a "horizontal start pulse STHR", and the horizontal start pulse STHR returned to the timing controller 10 after being circulated through the image signal line driving devices 101 to 108 will be referred to as a "returned horizontal pulse $STHR_B$"

Figure 14:
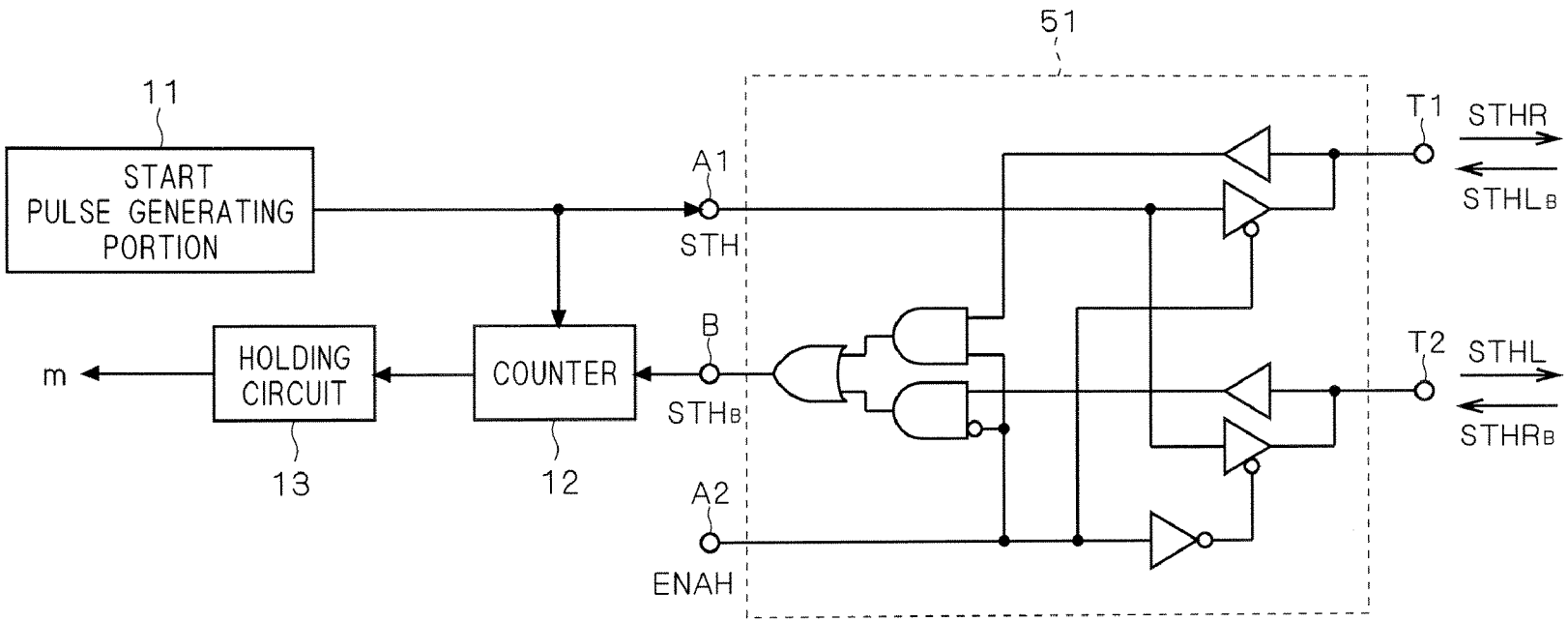
FIG. 14 is a block diagram illustrating a horizontal start pulse generating portion and a horizontal resolution determination portion included in a timing controller according to the sixth embodiment.

FIG. 14 is a block diagram illustrating a horizontal start pulse generating portion and a horizontal resolution determination portion included in the timing controller 10 according to the present embodiment. In the structure of the same figure, an inputting/outputting switching circuit 51 is provided in the inputting/outputting stage for the horizontal start pulse STH and the returned horizontal start pulse $STH_B$ in FIG. 2. In the case where the designation signal ENAH is "L" (Low), the inputting/outputting switching circuit 51 outputs the horizontal start pulse STH generated from the start pulse generating portion 11 to a terminal T1 and also transfers a signal input to a terminal T2 to the counter 12. Further, in the case where the designation signal ENAH is "H" (High), the inputting/outputting switching circuit 51 outputs the horizontal start pulse STH generated from the start pulse generating portion 11 to the terminal T2 and also transfers a signal input to the terminal T1 to the counter 12. As described above, the inputting/outputting switching circuit 51 is capable of interchanging the inputting/outputting relationship between the terminal T1 and the terminal T2, based on the designation signal ENAH.

Accordingly, in the structure of FIG. 14, when the terminal T1 is connected to the image signal line driving device 101 and the terminal T2 is connected to the image signal line driving device 108, in the case where the designation signal ENAH is "L", the timing controller 10 can transmit the horizontal start pulse STHL to the image signal line driving device 101 and can receive the returned horizontal start pulse $STHL_B$ from the image signal line driving device 108. On the contrary, in the case where the designation signal ENAH is "H", the timing controller 10 can transmit the horizontal start pulse STHR to the image signal line driving device 108 and can receive the returned horizontal start pulse $STHR_B$ from the image signal line driving device 101. Further, similarly to in the first embodiment, the counter 12 can measure the interval between the transmission and the reception thereof and the holding circuit 13 can hold the measurement value, which enables the timing controller 10 to determine and recognize the horizontal resolution of the liquid crystal display panel 301.

As described above, by providing the inputting/outputting switching circuit 51 in the horizontal resolution determination portion of the timing controller 10, the present invention can be applied to liquid crystal display devices capable of switching the direction of intake of RGB data and, in this case, it is possible to offer the same effects as those in the first embodiment.

Seventh Embodiment

In the liquid crystal display devices described in the aforementioned embodiments, the direction of the order in which the scanning line driving circuits drive the scanning lines (hereinafter, referred to as "the direction of vertical scanning"), namely the direction in which the vertical start pulse is transferred to the scanning line driving devices, is fixed to a single direction. However, some liquid crystal displays are capable of switching the direction of vertical scanning, depending on the specification of RGB data.

Figure 15:
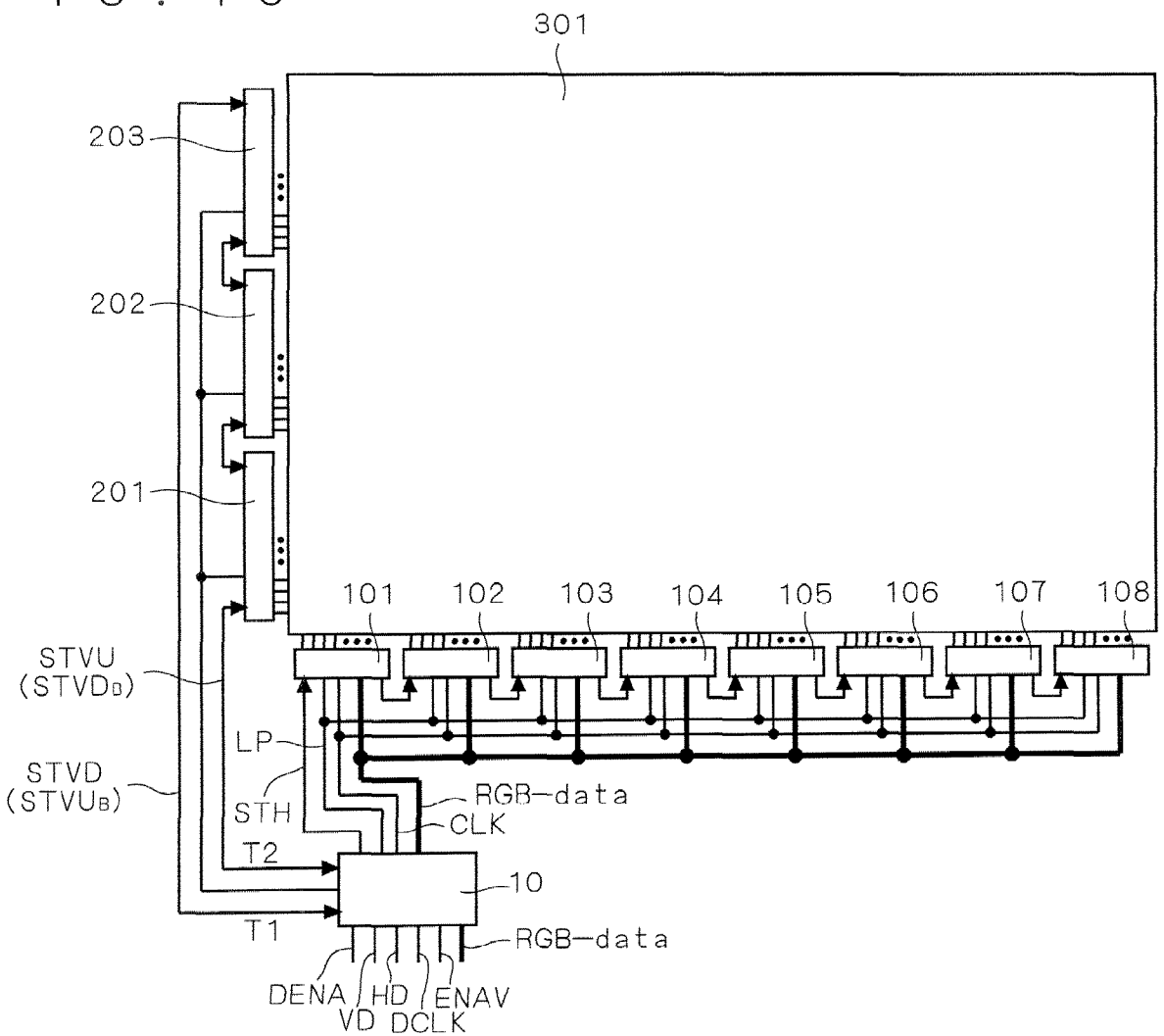
FIG. 15 is a block diagram illustrating main portions of a liquid crystal display device according to a seventh embodiment.

In the seventh embodiment, the present invention is applied to a liquid crystal display device capable of switching the direction of vertical scanning, namely the direction in which the vertical start pulse is transferred. FIG. 15 is a block diagram illustrating main portions of the liquid crystal display device according to the present embodiment. Along with RGB data, a designation signal ENAV which designates the direction of vertical scanning is input to the timing controller 10. Namely, the timing controller 10 operates, based on the designation signal ENAV, to switch between outputting the vertical start pulse STV to the scanning line driving device 201 and outputting it to the scanning line driving device 203.

Hereinafter, for ease of description, the vertical start pulse STV output from the timing controller 10 to the scanning line driving device 201 will be referred to as a "vertical start pulse STVU", and the vertical start pulse STVU returned to the timing controller 10 after being circulated through the scanning line driving devices 201 to 203 will be referred to as a "returned vertical pulse $STVU_B$". Further, the vertical start pulse STV output from the timing controller 10 to the scanning line driving device 203 will be referred to as a "vertical start pulse STVD", and the vertical start pulse STVD returned to the timing controller 10 after being circulated through the scanning line driving devices 203 to 201 will be referred to as a "returned vertical start pulse $STVD_B$".

Figure 16:
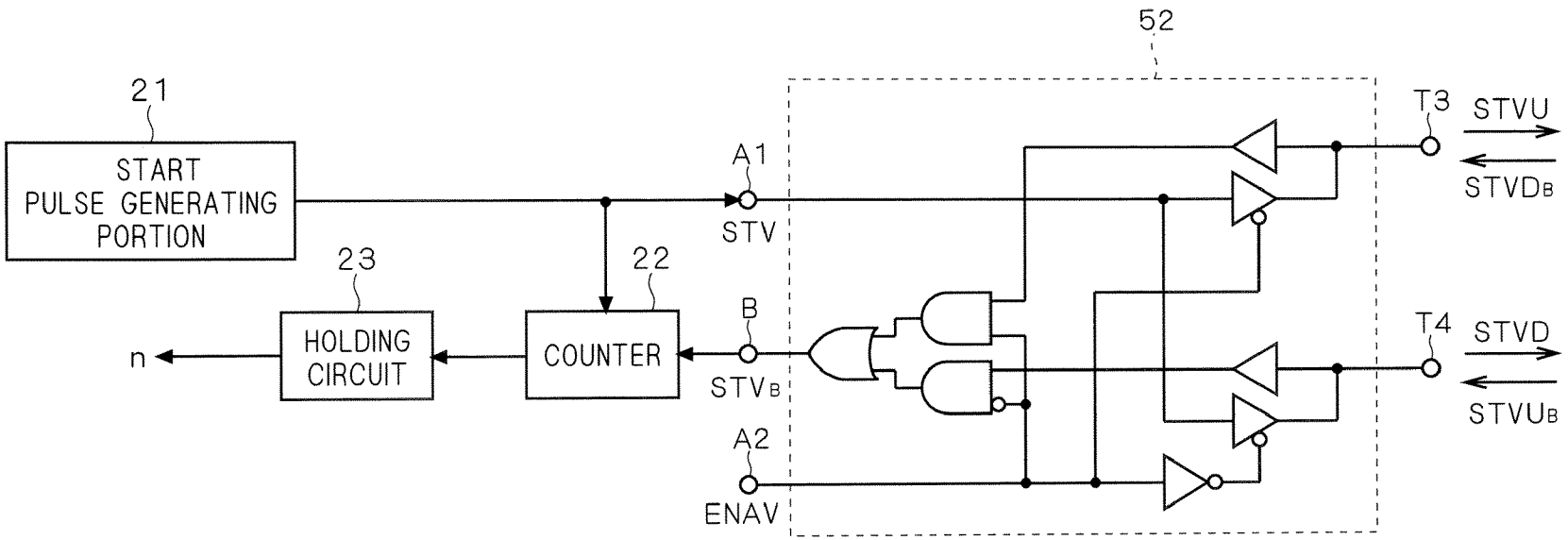
FIG. 16 is a block diagram illustrating a horizontal start pulse generating portion and a vertical resolution determination portion included in the timing controller according to the seventh embodiment.

FIG. 16 is a block diagram illustrating a vertical start pulse generating portion and a vertical resolution determination portion included in the timing controller 10 according to the present embodiment. In the structure of the same figure, an inputting/outputting switching circuit 52 is provided in the inputting/outputting stage for the vertical start pulse STV and the returned vertical start pulse $STV_B$ in FIG. 5. In the case where the designation signal ENAV is "L" (Low), the inputting/outputting switching circuit 52 outputs the vertical start pulse STV generated from the start pulse generating portion 21 to a terminal T3 and also transfers a signal input to a terminal T4 to the counter 22. Further, in the case where the designation signal ENAV is "H" (High), the inputting/outputting switching circuit 52 outputs the vertical start pulse STV generated from the start pulse generating portion 21 to the terminal T4 and also transfers a signal input to the terminal T3 to the counter 22. As described above, the inputting/outputting switching circuit 52 is capable of interchanging the inputting/outputting relationship between the terminal T3 and the terminal T4, based on the designation signal ENAV.

Accordingly, in the structure of FIG. 16, when the terminal T3 is connected to the scanning line driving device 201 and the terminal T4 is connected to the scanning line driving device 203, in the case where the designation signal ENAV is "L", the timing controller 10 can transmit the vertical start pulse STVU to the scanning line driving device 201 and can receive the returned vertical start pulse $STVU_B$ from the scanning line driving device 203. On the contrary, in the case where the designation signal ENAV is "H", the timing controller 10 can transmit the vertical start pulse STVD to the scanning line driving device 203 and can receive the returned vertical start pulse $STVD_B$ from the scanning line driving device 201. Further, similarly to in the second embodiment or the third embodiment, the counter 22 can measure the interval between the transmission and the reception thereof and the holding circuit 23 can hold the measurement value, which enables the timing controller 10 to determine and recognize the vertical resolution of the liquid crystal display panel 301.

As described above, by providing the inputting/outputting switching circuit 52 in the vertical resolution determination portion of the timing controller 10, the present invention can be applied to liquid crystal display devices capable of switching the direction of vertical scanning and, in this case, it is possible to offer the same effects as those in the second embodiment or the third embodiment.

Further, in the aforementioned respective embodiments, the operation of the timing controller for recognizing the resolution of the liquid crystal display panel may be either performed only a single time at power-up, for example, or repeatedly performed at predetermined time intervals to update the information about the resolution.

Further, while there have been described cases where the present invention is applied to a liquid crystal display device, the present invention is not limited thereto. Namely, the present invention can be applied to any other display devices than liquid crystal display devices, provided that the display devices employ a method of defining the timing of intake of image signals and the timing of driving of scanning lines with start pulses which are transferred to plural driving circuits in order.

While the invention has been shown and described in detail, the foregoing description is in all aspects illustrative and not restrictive. It is therefore understood that numerous modifications and variations can be devised without departing from the scope of the invention.

What is claimed is:

1. An image display device comprising:

a display panel including plural image signal lines and plural scanning lines;

plural driving circuits for driving said plural image signal lines; and a timing controller which transmits image signals to said plural driving circuits and also transmits a start pulse for defining the timings when the respective driving circuits take in said image signals, wherein said plural driving circuits are connected to one another in a cascade manner in order to enable circulating said start pulse through said plural driving circuits, and said timing controller receives said start pulse circulated through said plural driving circuits and determines the resolution of said display panel in the direction in which said image signal lines are arranged, based on the interval between the transmission and the reception of said start pulse.

2. The image display device according to claim 1, wherein said timing controller includes:

a counter for measuring the interval between the transmission and the reception of said start pulse; and a holding circuit for holding the measurement value of said counter.

3. An image display device comprising:

a display panel including plural image signal lines and plural scanning lines;

plural driving circuits for driving said plural scanning lines; and a timing controller which transmits a start pulse for defining the timings when the respective driving circuits drive said scanning lines, wherein said plural driving circuits are connected to one another in a cascade manner in order to enable circulating said start pulse through said plural driving circuits, and said timing controller receives said start pulse circulated through said plural driving circuits and determines the resolution of said display panel in the direction in which said scanning lines are arranged, based on the interval between the transmission and the reception of said start pulse.

4. The image display device according to claim 3, wherein said timing controller includes:

a counter for measuring the interval between the transmission and the reception of said start pulse; and a holding circuit for holding the measurement value of said counter.

5. An image display device comprising:

a display panel including plural image signal lines and plural scanning lines;

plural driving circuits for driving said plural image signal lines, the plural driving circuits being divided into plural groups; and a timing controller which transmits image signals to said plural driving circuits and also transmits, to said respective groups, start pulses for defining the timings when the driving circuits take in said image signals, wherein said plural driving circuits are connected to one another in a cascade manner, in order to enable circulating said start pulses through said respective groups, and said timing controller receives said start pulses circulated through said driving circuits in said respective groups and determines the resolution of said display panel in the direction in which said image signal lines are arranged, based on the intervals between the transmissions and the receptions of said respective start pulses.

6. The image display device according to claim 5, wherein said timing controller includes:

plural counters for measuring the respective intervals between the transmission and the reception of said start pulses which are transmitted to and received from the respective groups; and plural holding circuits for holding the respective measurement values of said plural counters.

7. An image display device comprising:

a display panel including plural image signal lines and plural scanning lines;

plural driving circuits for driving said plural scanning lines, the plural driving circuits being divided into plural groups; and a timing controller which transmits, to said respective groups, start pulses for defining the timings when the driving circuits drive said scanning lines, wherein said plural driving circuits are connected to one another in a cascade manner, in order to enable circulating said start pulses through said respective groups, and said timing controller receives said start pulses circulated through said driving circuits in said respective groups and determines the resolution of said display panel in the direction in which said scanning lines are arranged, based on the intervals between the transmissions and the receptions of said respective start pulses.

8. The image display device according to claim 7, wherein said timing controller includes:

plural counters for measuring the respective intervals between the transmission and the reception of said start pulses which are transmitted to and received from the respective groups; and plural holding circuits for holding the respective measurement values of said plural counters.

9. A timing controller which outputs a start pulse for defining the timings of operations of driving circuits for driving image signal lines or scanning lines in an image display device, the timing controller comprising:

an output terminal for applying said start pulse to said driving circuits;

an input terminal for inputting to the timing controller a predetermined signal corresponding to the start pulse circulated through one or more of the driving circuits;

a counter for measuring the interval between the outputting of the start pulse from said output terminal and the inputting of said predetermined signal to said input terminal; and a holding circuit for holding the measurement value of said counter.

10. The timing controller according to claim 9, comprising plural groups of said output terminal, said input terminal, said counter and said holding circuit.

11. The timing controller according to claim 9, further comprising:

an inputting/outputting switching circuit for switching between a first state where a first terminal functions as said output terminal and a second terminal functions as said input terminal and a second state where said first terminal functions as said input terminal and said second terminal functions as said output terminal.

* * * * *